US005092310A

United States Patent [19]

Walen et al.

[11] Patent Number: 5,092,310

[45] Date of Patent: * Mar. 3, 1992

[54] MINING PICK

[75] Inventors: Robert C. Walen, Powell; David E. Slutz, Worthington, both of Ohio

[73] Assignee: General Electric Company, Worthington, Ohio

[ * ] Notice: The portion of the term of this patent subsequent to Jul. 25, 2006 has been disclaimed.

[21] Appl. No.: 355,513

[22] Filed: May 23, 1989

[51] Int. Cl.[5] ..... B28D 1/26

[52] U.S. Cl. ..... 125/43; 125/40; 299/79; 299/91

[58] Field of Search ..... 299/79, 91; 175/410; 125/40, 42, 43; 407/118, 119

[56] References Cited

U.S. PATENT DOCUMENTS 2,785,883 3/1957 Lundquist ..... 299/79
4,252,102 2/1981 Phaal et al. ..... 407/119 X
4,373,593 2/1983 Phaal et al. ..... 407/119 X
4,527,998 7/1985 Knemeyer ..... 51/309
4,619,563 10/1986 Doting ..... 407/118
4,850,523 7/1989 Slutz ..... 228/121
4,854,784 8/1989 Murray et al. ..... 407/119 X
4,899,922 2/1990 Slutz et al. ..... 228/121

*Primary Examiner*—M. Rachuba
*Attorney, Agent, or Firm*—Andrew C. Hess

[57] ABSTRACT

Disclosed is a mining pick of the type having a shank and head with the head having an integrally bonded cutting tip, the cutting tip having a metallic substrate which is bonded to the head and also bonded to a superabrasive material cutting surface, wherein a thin section of the superabrasive material is bonded to the metallic substrate such that at least one edge of the thin dimension of the superabrasive material is oriented such that the digging action of the mining pick is that of a slicing or cutting action, rather than a crushing or pawing action.

31 Claims, 1 Drawing Sheet

MINING PICK

BACKGROUND OF THE INVENTION

1. Field

The invention relates to tools used for the winning of minerals, particularly mining picks.

2. State of the Art

Tools for the winning of minerals have generally been known for many years. In commercial mining operations, such as longwall coal mining, a plurality of mining picks are typically mounted on a rotatable drum or disk. The picks are mounted such that when the drum or disk is rotated the picks traverse the surface of the strata of earth being mined, thereby digging the surface and releasing the particular mineral being sought. The pick is removable from the rotatable drum or disk so that it can be replaced when it becomes dull, broken or fractured.

The typical commercial mining pick has a shank and a head attached to the shank. The shank is the portion of the pick which is removably attached to the rotatable drum or disk. The head of the pick is that portion which digs the strata of earth being mined when the drum or disk is rotated. Integral with the head, on its leading cutting surface, is a cutting tip. The shank and head are typically manufactured of a hardened metal, such as steel, and the cutting tip is manufactured of a hard and abrasive material. Typical prior art mining picks are disclosed in U.S. Pat. Nos. 4,143,920 and 4,657,308.

It is well known in the prior art to use carbide shaped in either a conical or a wedge design as the hard and abrasive material for the cutting tip. Carbide has the disadvantage of wearing quickly in hard earthen strata, thereby resulting in short tool life and excessive down time in the mining operation for pick replacement. In recent years new materials have been developed which replace the carbide or at least the leading surface of the carbide cutting tip. Through the use of high pressure, high temperature technology, superabrasive materials such as polycrystalline diamond compacts, commonly known as "PDC," and polycrystalline cubic boron nitride compacts, known and sold by General Electric Company under the trademark "BZN® Compacts," have been produced for use as the leading surfaces in implements for mining, drilling and other cutting operations. PDC materials which are useful for these purposes are disclosed in U.S. Pat. No. Re 32,380 which teaches a PDC material which is sold by General Electric Company under the trademark STRATAPAX®, U.S. Pat. No. 4,224,380 which teaches a thermally stable PDC, and U.S. Pat. No. 4,738,689 which teaches a coated thermally stable PDC, the latter materials being sold by General Electric Company under the trademark GEOSET®. BZN® Compacts are disclosed in U.S. Pat. Nos. 3,767,371 and 3,743,489. The foregoing General Electric Company patents are assigned to the same assignee as the present invention, and are incorporated herein by this reference.

The superabrasive material is usually backed by and bonded to a metallic substrate which is manufactured of a harder material than the head of the pick. The metallic substrate is also bonded to the head of the pick so that the metallic substrate acts as a layer between the superabrasive material and head. The metallic substrate backing is typically oriented to provide mechanical support for the superabrasive material to reduce fracturing thereof and to reduce stress on the superabrasive material metallic substrate bond. Metallic substrate materials which have been used in the past are carbide or a hard cemented metal such as cemented carbide.

The shape of the prior art PDC or BZN® Compact is typically one having flat surfaces, such as a disk or cylinder. If the compact is shaped in the form of a disk, it is bonded to the substrate along one of its flat surfaces, with the opposite nonbonded flat surface being the lead surface which comes into contact with strata of earth in the mining or drilling process. If the shape of the compact is a cylinder, the cylinder is typically imbedded along its longitudinal axis in the substrate, leaving an end surface of the cylinder exposed out of the substrate which acts as the digging surface. The use of a cylindrical PDC imbedded in a cemented metal substrate is taught by South African Patent Application Serial No. 846960. The size of the PDC or BZN® Compact used in these prior art PDC and BZN® Compact pick designs and the fabrication techniques which are required result in approximately a tenfold cost increase of prior art PDC or BZN® Compact mining picks over the prior art non-compact mining picks, while the present invention results in approximately only a fourfold cost increase.

Prior art picks using a broad surface for the digging surface dig through a crushing or pawing action. In carbide tiped picks the broad digging surface results from the wear of the carbide. In PDC or BZN® Compact tipped picks, a broad flat surface of the compact is the digging surface. The crushing or pawing digging action results in the undesirable effects of high air concentrations of particulate dust, high heat generation, high energy consumption and relatively short tool life.

SUMMARY OF THE INVENTION

Objectives

It is an object of the invention to provide a mining pick which utilizes a superabrasive material in the cutting tip which does not dig by a crushing or pawing action. Further objectives of the invention are to provide a mining pick which has an increased tool life and is less expensive to manufacture over the prior art mining picks which utilize superabrasive materials. Other objectives of the invention are to provide a mining pick which reduces the air concentration of particulate matter and amount of heat generated through the mining operation, thereby reducing the health hazard and potential for explosion in the mining operation. Another objective of the invention is to reduce the overall cost of a mining operation by providing a mining pick which has increased tool life, results in lower energy consumption in the mining operation and decreases the cost of tool fabrication through utilizing less superabrasive material and lower fabrication costs than prior art mining picks. A further objective of the invention is to provide a mining pick which lasts longer and digs more efficiently and faster through abrasive or hard geological formations thereby reducing the cost of mining operations through reduced down time for mining pick replacement.

Features

In the accomplishment of the foregoing objectives, the invention is a mining pick of the type having a shank and head with the head having an integrally bonded cutting tip, the cutting tip having a metallic substrate which is bonded to the head and also bonded to a superabrasive material cutting surface, wherein a thin section of the superabrasive material is bonded to the metallic substrate such that a leading face of the thin dimension of the superabrasive material is oriented such that the digging action of the mining pick is that of a slicing or cutting action, rather than a crushing or pawing action. The preferred orientation of the thin section of super abrasive material is one such that the plane in which the leading face of the thin section of the superabrasive material lies is substantially perpendicular to the plane in which the mining pick moves. It is also preferrable that the thin section of superabrasive material be set into a slot in the metallic substrate.

Preferably the metallic substrate is either carbide or a cemented hard metal such as cemented carbide. The superabrasive material is preferably either a PDC of polycrystalline diamond, thermally stable polycrystalline diamond or coated thermally stable polycrystalline diamond, which are manufactured by General Electric Company and sold under the trademarks STRATAPAX ® and GEOSET ®; or a BZN ® Compact. The PDC or BZN ® Compact is preferrably bonded to the metallic substrate by brazing, and it is also preferable to create a strong bond between the PDC or BZN ® Compact and metallic substrate through the use of a high temperature brazing alloy. The use of a high temperature brazing alloy can be accomplished if the PDC which is utilized is coated thermally stable PDC material as taught in recently issued U.S. Pat. No. 4,738,689. Alternatively, the use of a high temperature brazing alloy can be accomplished through the brazing techniques and materials taught in co-pending U.S. patent application Ser. Nos. 158,336 and 158,575, both of which were filed on Feb. 22, 1988. The foregoing General Electric Company patent applications are assigned to the same assignee as the present invention, and are incorporated herein by this reference.

THE DRAWING

DETAILED DESCRIPTION OF THE ILLUSTRATED EMBODIMENT

Figure 1:
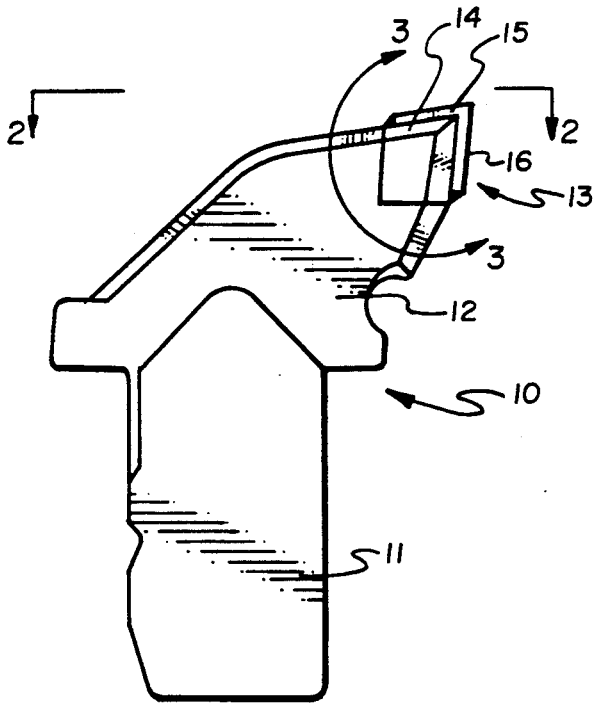
FIG. 1 is a perspective sideview of the improved mining pick.
Figure 2:
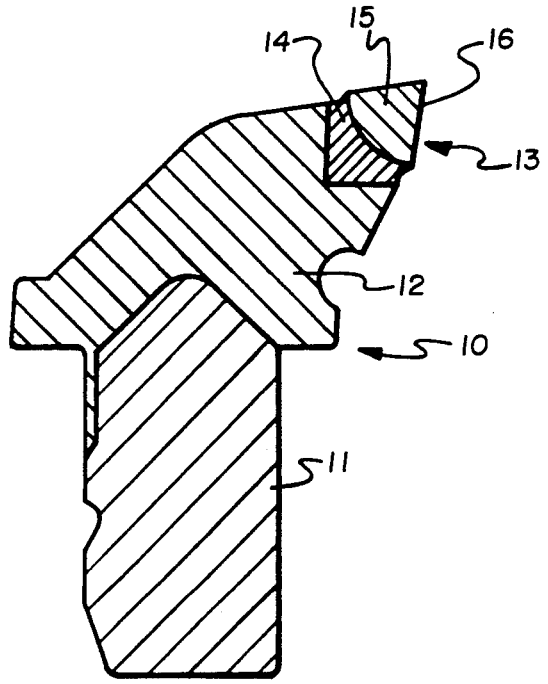
FIG. 2 is a vertical section taken on line 2—2 of FIG. 1.
Figure 3:
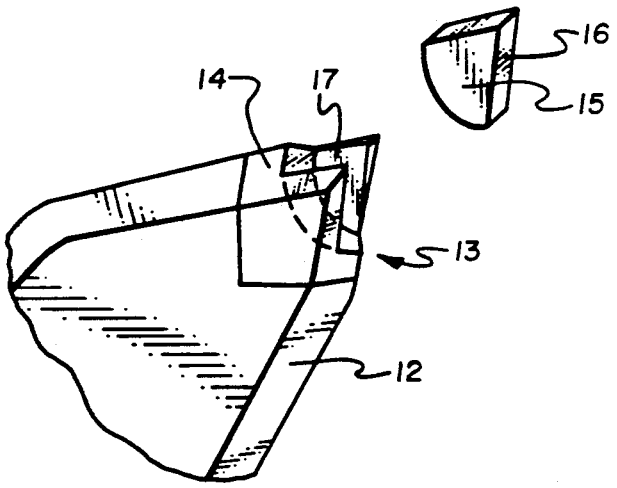
FIG. 3 is an enlarged perspective exploded view of the cutting tip of the improved mining pick of area 3—3 of FIG. 1 which is slightly rotated.

Referring to FIG. 1, FIG. 2 and FIG. 3, the mining pick 10 has a shank 11 and an integral head 12. The shank 11 is the portion of the pick which allows for removable attachment of the pick 10 into a rotary drum or disk of a typical longwall mining machine. Depending upon the type of mining machine, the shank 11 may be of a variety of shapes to accommodate the attaching mechanism of the particular rotary drum or disk. The head 12 is the portion of the pick which extends outwardly from the rotary drum or disk and houses a cutting tip 13. Typically the shank 11 and head 12 are manufactured out of a hardened metal, such as steel. The cutting tip 13 is positioned in the head 12 such that the cutting tip 13 is the leading portion of the head 12 which comes into initial contact with earthen strata being mined.

The cutting tip 13 is bonded to the head 12 and is usually manufactured of harder and more abrasive materials than the head 12 and shank 11. The cutting tip 13 comprises a metallic substrate 14 and a superabrasive compact 15. The metallic substrate 14 is bonded to the head 12 by standard bonding techniques. The superabrasive compact 15 is bonded to the metallic substrate 14 such that the superabrasive compact 15 is the initial cutting or digging surface of the cutting tip 13. The metallic substrate 14 is preferrably carbide or a cemented hard metal, such as cemented carbide. If the metallic substrate 14 is cemented carbide, it is preferrably selected from the group consisting of cemented tungsten carbide, cemented titanium carbide, cemented tungsten-molybdenum carbide, and cemented tantalum carbide. The superabrasive compact 15 is preferrably a PDC or a BZN ® Compact. If the superabrasive compact 15 is a PDC, it is preferrably selected from the group consisting of polycrystalline diamond, thermally stable polycrystalline diamond, and coated thermally stable polycrystalline, diamond.

Preferably, the superabrasive compact 15 is bonded to the metallic substrate 14 by brazing. One such method of brazing is that disclosed in co-pending General Electric Company U.S. patent application Ser. No. 158,336, which has been incorporated herein by reference. That application teaches a method for bonding a thermally stable PDC or a BZN ® Compact to a carbide substrate wherein the carbide substrate is placed in thermal contact with a heat sink and the thermally stable PDC is placed in thermal contact with a heat source during the brazing operation. Such fabrication technique avoids the residual stresses which otherwise would result by virtue of the differential of the coefficients of thermal expansion between the carbide substrate and the thermally stable PDC. This brazing technique also takes advantage of the high thermal conductivity of the thermally stable PDC.

Another useful brazing technique is that disclosed in co-pending General Electric Company U.S. patent application Ser. No. 158,575, which has been incorporated herein by reference. That application discloses the brazing of a thermally stable PDC to a carbide substrate using a brazing alloy having a liquidus above about 700° C. and containing an effective amount of chromium, with the proportion of chromium ranging between 1% to 20% and advantageously being between 5% and 20% by weight of the braze alloy composition. In this brazing technique, the thermally stable PDC can be bonded to the carbide substrate by disposing the chromium-containing braze alloy between the thermally stable PDC and carbide substrate and furnace brazing the composite. In this technique, the chromium braze alloy may be placed between the thermally stable PDC and carbide substrate through the use of a disk, wire, or foil; or, in the alternative, either the surface of the thermally stable PDC which is to be mated with the carbide substrate or the entire thermally stable PDC can be coated with the chromium braze alloy through the use of known deposition technology.

The superabrasive compact 15 is shaped in the form of a thin section. The thin section of superabrasive compact 15 is oriented on the metallic substrate 14 such that at the leading face 16 of the thin section of superabrasive compact 15 is oriented such that the digging action of the pick 10 is through a slicing or cutting action. The preferred orientation of the thin section of superabrasive compact 15 is one such that the plane in which the leading face 16 of the thin section of superabrasive compact 15 lies is substantially perpendicular with the plane in which pick 10 moves.

It is preferred that the thin section of the superabrasive compact 15 be set into a pre-cut slot 17 in the metallic substrate 14. The setting of the thin section of superabrasive compact 15 into a pre-cut slot 17 in the metallic substrate 14 results in a strong superabrasive material-metallic substrate bond because of the increased surface area between the thin section of superabrasive compact 15 and the metallic substrate 14, and in additional mechanical support which is provided by the partial encasement of the thin section of superabrasive compact 15 in the metallic substrate 14.

It is advantageous to manufacture the thin section of superabrasive compact 15 in the shape of a disk and then cut the disk such that pie-shaped wedges are formed. This shape allows for the use of existing prior art manufacturing techniques for superabrasive compacts utilized in cutting picks which dig through a pawing or crushing action. It is also advantageous to mount the wedge-shaped thin section of the superabrasive compact 15 into the pre-cut slot 17 such that the apex of the pie-shaped wedge is the initial penetrating surface of the pick and the curved portion of the pie-shaped wedge mates with the inner-bottom surface of the pre-cut slot 17.

Whereas this invention is here illustrated and described with specific reference to an embodiment thereof presently contemplated as the best mode in carrying out such invention, it is to be understood that various changes may be made in adapting the invention to different embodiments without departing from the broad inventive of concepts disclosed herein and comprehended by the claims that follow.

We claim:

1. A mining pick comprising:

(a) a shank;

(b) a head attached to the shank; and (c) a cutting tip integrally bonded to the head, said cutting tip comprising (i) a metallic substrate which is bonded to the head and also braced to the superabrasive material cutting surface such that the brazing conditions minimize thermal damage to the metallic substrate and superabrasive material, and (ii) the superabrasive material being formed in a thin section and being bonded to the metallic substrate such that a leading face of the thin section of the superabrasive material is oriented such that the digging action of the mining pick is through a slicing or cutting action.

2. A mining pick as recited in claim 1 wherein the orientation of the thin section of superabrasive material is such that the plane in which the leading face of the thin section of the superabrasive material lies is substantially perpendicular to the plane in which the mining pick moves.

3. A mining pick as recited in claims 1 or 2 wherein the superabrasive material is selected from the group consisting of thermally stable polycrystalline diamond and coated thermally stable polycrystalline diamond.

4. A mining pick as recited in claims 1 or 2 wherein the metallic substrate is a cemented metal carbide.

5. A mining pick as recited in claim 4 wherein the cemented metal carbide is selected from the group consisting of cemented tungsten carbide, cemented titanium carbide, cemented tungsten-molybdenum carbide and cemented tantalum carbide.

6. A mining pick as recited in claims 1 or 2 wherein the brazing further comprises using a brazing alloy having a liquidus above at 700° C. and containing an effective amount of chromium.

7. A mining pick comprising:

(a) a shank;

(b) a head attached to the shank; and (c) a cutting tip integrally bonded to the head, said cutting tip comprising (i) a metallic substrate which is bonded to the head and also brazed to a superabrasive material cutting surface such that the brazing conditions minimize thermal damage to the metallic substrate and superabrasive material, and (ii) the superabrasive material being formed in a thin wedge and being bonded to the metallic substrate such that the wedge is mated to a pre-cut slot in the metallic substrate such that a leading face of the wedge is oriented such that the digging action of the mining pick is through a slicing or cutting action.

8. A mining pick as recited in claim 7 wherein the orientation of the thin section of the superabrasive material is such that the plane in which the leading face of the thin section of superabrasive material lies is substantially perpendicular to the plane in which the mining pick moves.

9. A mining pick as recited in claims 7 or 8 wherein the superabrasive material is selected from the group consisting of thermally stable polycrystalline diamond and coated thermally stable polycrystalline diamond.

10. A mining pick as recited in claims 7 or 8 wherein the metallic substrate is a cemented metal carbide.

11. A mining pick as recited in claim 10 wherein the cemented metal carbide is selected from the group consisting of cemented tungsten carbide, cemented titanium carbide, cemented tungsten-molybdenum carbide and cemented tantalum carbide.

12. A mining pick as recited in claims 7 or 8 wherein the brazing further comprises using a brazing alloy having a liquidus above at 700° C. and containing an effective amount of chromium.

13. A method for making a mining pick, which comprises integrally bonding a cutting tip to a mining pick head having a shank, the cutting tip being formed by bonding a metallic substrate to the head, brazing the metallic substrate to a thin section of superabrasive material such that the brazing conditions minimize thermal damage to the metallic substrate and superabrasive material, and a leading face of the thin section of the superabrasive material being oriented such that the digging action of the mining pick is through a slicing or cutting action.

14. A method as recited in claim 13 wherein the orientation of the thin section of the superabrasive material is such that the plane in which the leading face of the thin section of superabrasive material lies is substantially perpendicular to the plane in which the mining pick moves.

15. A method as recited in claims 13 or 14 wherein the superabrasive material is selected from the group consisting of thermally stable polycrystalline diamond and coated thermally stable polycrystalline diamond.

16. A method as recited in claims 13 or 14 wherein the metallic substrate is a cemented metal.

17. A method as recited in claim 16 wherein the cemented metal is selected from the group consisting of cemented tungsten carbide, cemented titanium carbide, cemented tungsten-molybdenum carbide and cemented tantalum carbide.

18. A method as recited in claims 13 or 14 wherein the metallic substrate and superabrasive material are brazed by using a brazing alloy having a liquidus above at 700° C. and containing an effective amount of chromium.

19. A mining pick consisting essentially of:

(a) a shank;

(b) a head attached to the shank; and (c) a cutting tip integrally bonded to the head, said cutting tip comprising (i) a metallic substrate which is bonded to the head and also brazed to a superabrasive material cutting surface such that the brazing conditions minimize thermal damage to the metallic substrate and superabrasive material, and (ii) the superabrasive material being formed in a thin section and being bonded to the metallic substrate such a leading face of the thin section of the superabrasive material is oriented such that the digging action of the mining pick is through a slicing or cutting action.

20. A mining pick as recited in claim 1 wherein the brazing further comprises using a brazing alloy having a liquidus above about 700° C., placing the metallic substrate in thermal contact with a heat sink and placing the superabrasive material in contact with a heat source during the brazing operation.

21. A mining pick as recited in claim 20 wherein the brazing filler alloy contains an effective amount of chromium.

22. A mining pick as recited in claim 2 wherein the brazing further comprises using a brazing alloy having a liquidus above about 700° C., placing the metallic substrate in thermal contact with a heat sink and placing the superabrasive material in contact with a heat source during the brazing operation.

23. A mining pick as recited in claim 22 wherein the brazing filler alloy contains an effective amount of chromium.

24. A mining pick as recited in claim 7 wherein the brazing further comprises using a brazing filler alloy having a liquidus above about 700° C., placing the metallic substrate in thermal contact with a heat sink and placing the superabrasive material in contact with a heat source during the brazing operation.

25. A mining pick as recited in claim 24 wherein the brazing filler alloy contains an effective amount of chromium.

26. A mining pick as recited in claim 8 wherein the brazing further comprises using a brazing filler alloy having a liquidus above about 700° C., placing the metallic substrate in thermal contact with a heat sink and placing the superabrasive material in contact with a heat source during the brazing operation.

27. A mining pick as recited in claim 26 wherein the brazing filler alloy contains an effective amount of chromium.

28. A method for making a mining pick as recited in claim 13 wherein the brazing further comprises using a brazing filler alloy having a liquidus above about 700° C., placing the metallic substrate in thermal contact with a heat sink and placing the superabrasive material in contact with a heat source during the brazing operation.

29. A method for making a mining pick as recited claim 28 wherein the brazing filler alloy contains an effective amount of chromium.

30. A method for making a mining pick as recited in claim 14 wherein the brazing further comprises using a brazing filler alloy having a liquidus above about 700° C., placing the metallic substrate in thermal contact with a heat sink and placing the superabrasive material in contact with a heat source during the brazing operation.

31. A method for making a mining pick as recited in claim 30 wherein the brazing filler alloy contains an effective amount of chromium.

* * * * *